US010140918B2

(12) United States Patent
Song et al.

(10) Patent No.: US 10,140,918 B2
(45) Date of Patent: Nov. 27, 2018

(54) ACTIVELY DRIVEN ORGANIC LIGHT-EMITTING DISPLAY APPARATUS

(71) Applicant: BOE Technology Group Co., Ltd., Beijing (CN)

(72) Inventors: Chen Song, Beijing (CN); Liye Duan, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 92 days.

(21) Appl. No.: 14/777,831

(22) PCT Filed: Feb. 27, 2015

(86) PCT No.: PCT/CN2015/073342
§ 371 (c)(1),
(2) Date: Sep. 17, 2015

(87) PCT Pub. No.: WO2016/045315
PCT Pub. Date: Mar. 31, 2016

(65) Prior Publication Data

US 2016/0307503 A1 Oct. 20, 2016

(30) Foreign Application Priority Data

Sep. 26, 2014 (CN) ..... 2014 1 0503025

(51) Int. Cl.
*G09G 5/00* (2006.01)
*G09G 3/3233* (2016.01)
(Continued)

(52) U.S. Cl.
CPC ..... *G09G 3/3233* (2013.01); *G09G 3/2007* (2013.01); *G09G 3/3291* (2013.01);
(Continued)

(58) Field of Classification Search
CPC ..... G09G 2300/0842; G09G 3/3233; G09G 2320/0295
See application file for complete search history.

(56) References Cited

U.S. PATENT DOCUMENTS

2008/0174574 A1 7/2008 Yoo
2008/0238327 A1* 10/2008 Cho ..... G09G 3/3241 315/169.3

FOREIGN PATENT DOCUMENTS

CA 2550102 A1 9/2006
CN 1606057 A 4/2005
(Continued)

OTHER PUBLICATIONS

First Office Action, including Search Report, for Chinese Patent Application No. 201410503025.3, dated Jan. 20, 2016, 9 pages.
(Continued)

*Primary Examiner* — Nan-Ying Yang
(74) *Attorney, Agent, or Firm* — Westman, Champlin & Koehler, P.A.

(57) ABSTRACT

An embodiment of the present disclosure provides an actively driven organic light-emitting display apparatus to eliminate a defect in which the current flowing through the lighting device in the actively driven organic light-emitting display apparatus is affected by the instable current caused by the instable threshold voltage of the drive transistor, so that the current flowing through the lighting device is accurate and make the brightness of the whole actively driven organic light-emitting display apparatus be even. The display apparatus comprises a light emitting device, a light emitting device drive unit, a first switch unit, a second switch unit, a current control unit and a resistor which constitute a feedback loop. An input terminal of the current control unit is input a data signal to control that the current
(Continued)

of the light emitting device is only associated with the resistor, voltage of the input data signal and the supply voltage.

15 Claims, 9 Drawing Sheets

(51) Int. Cl.
*G09G 3/20* (2006.01)
*G09G 3/3291* (2016.01)

(52) U.S. Cl.
CPC ..... *G09G 2300/0819* (2013.01); *G09G 2300/0842* (2013.01); *G09G 2300/0861* (2013.01); *G09G 2310/0291* (2013.01); *G09G 2320/0233* (2013.01); *G09G 2320/0295* (2013.01); *G09G 2320/043* (2013.01); *G09G 2320/045* (2013.01)

(56) References Cited

FOREIGN PATENT DOCUMENTS

| | | | |
|---|---|---|---|
| CN | 1975847 | A | 6/2007 |
| CN | 101286298 | A | 10/2008 |
| CN | 101751860 | A | 6/2010 |
| CN | 102708786 | A | 10/2012 |
| CN | 102890910 | A | 1/2013 |
| CN | 104282264 | A | 1/2015 |
| KR | 10-2007-0000831 | A | 1/2007 |
| KR | 10-2011-0095742 | A | 8/2011 |

OTHER PUBLICATIONS

International Search Report and Written Opinion for PCT Application No. PCT/CN2015/073342; dated Jul. 6, 2015; 9 pages.
English translation of Box No. V of the Written Opinion for the International Searching Authority for PCT Application No. PCT/CN2015/073342; 1 page.
Extended European search report for European Patent Application No. 15763808.1, dated Mar. 12, 2018, 8 pages.

* cited by examiner

ACTIVELY DRIVEN ORGANIC LIGHT-EMITTING DISPLAY APPARATUS

CROSS-REFERENCE TO RELATED APPLICATION(S)

This application is a 371 National Stage Application of International Application No. PCT/CN2015/073342, filed 27 Feb. 2015, entitled "ACTIVELY DRIVEN ORGANIC LIGHT-EMITTING DISPLAY APPARATUS", which has not yet published, which claims priority to Chinese Application No. 201410503025.3 filed on Sep. 26, 2014 which are incorporated herein by reference in their entirety.

TECHNICAL FIELD

The present disclosure relates to display field, and particularly to an actively driven organic light-emitting display apparatus.

BACKGROUND

A drive circuit for an Organic Light-Emitting Diode (OLED) in the prior art is shown in FIG. 1. A Thin Film transistor (TFT) is directly driven by a grayscale voltage VDATA (i.e. voltage supplied by a data line, which is a voltage of the data signal) and different currents are generated according to various VDATA to lighten an OLED device.

A current flowing through a drive transistor of the OLED device (i.e. the TFT T1) may be obtained by a following equation:

$$I = \frac{1}{2}\mu_n \cdot Cox \cdot \frac{W}{L} \cdot (V_{GS} - V_{th})^2,$$

in which, $\mu^n$ is a channel carrier mobility, Cox is a capacitor of a gate oxide layer of the transistor, $$\frac{W}{L}$$

is an aspect ratio of the channel of the transistor, and it may be approximated that $V_{GS}=V_{DATA}-V_{OLED}$, $V_{th}$ represents a threshold voltage for the TFT transistor T1.

The current flowing through the OLED device is indicated as follows:

$$I_{OLED} = \frac{1}{2}\mu_n \cdot Cox \cdot \frac{W}{L} \cdot (V_{DATA} - V_{OLED} - V_{th})^2.$$

A TFT transistor T2 in FIG. 1 functions as a switch control transistor, the on/off of which is controlled by a voltage VSCAN of a line scanning signal; and the TFT transistor T1 in FIG. 1 is the drive transistor. When a scan line is on, the data signal of VDATA of an external circuit is stored in a storage capacitor (Cs) via the switch transistor T2. Such a data signal controls an amount of turned on current of the drive transistor TFT and also determine a grayscale of the OLED. When the scan line is off, a voltage stored in the capacitor Cs may keep the drive TFT in a turned on state.

In an actual display panel, due to mismatch at different positions caused by process offset, the threshold voltages of the TFT drive transistor T1 in the panel change, so that an operation voltage $V_{OLED}$ generated by the current flowing through the OLED lighting device also changes. Thus, there is inaccuracy in the current flowing through the OLED lighting device, so that uneven brightness occurs in the screen.

To sum up, the drive circuit for the OLED in the prior art is influenced by instable factors of the drive transistor and leads to inaccuracy of the current flowing through the OLED, so that the brightness in the whole screen is uneven.

SUMMARY

An embodiment of the present disclosure provides an actively driven organic light-emitting display apparatus to eliminate a defect in which the current flowing through the lighting device in the actively driven organic light-emitting display apparatus is affected by the instable current caused by the instable threshold voltage of the drive transistor, so that the current flowing through the lighting device is accurate and make the brightness of the whole actively driven organic light-emitting display apparatus be even.

According to one aspect of the present disclosure, there is provided an actively driven organic light-emitting display apparatus, which comprises a plurality of pixels arranged in a matrix and a drive device for driving the plurality of pixels to display; the drive device comprises at least one drive circuit corresponding to one column of pixels, each of the pixels including a light emitting device, a light emitting device drive unit, a first switch unit and a second switch unit; each of the drive circuit including a current control unit, wherein for any pixel in any one column of pixels and its corresponding drive circuit, the light emitting device drive unit is configured to drive the light emitting device to emit light; the current control unit comprises a resistor and an operational amplifier, one terminal of the operational amplifier is coupled to data signal and the other terminal of the operation amplifier is couple to one terminal of the resistor; the light emitting device, the light emitting device drive unit, the first switch unit, the second switch unit, the current control unit and the resistor constitute a feedback loop so that a control signal provided from the current control unit based on the data signal and a signal provide by the feedback loop is determined by a resistance value of the resistor, the input data signal voltage and the supply voltage.

With the actively driven organic light-emitting display apparatus, it avoids a situation in which the current flowing through the lighting device in the actively driven organic light-emitting display apparatus is affected by the instable current caused by the instable threshold voltage of the drive transistor. The present disclosure utilizes the feedback loop to control the current of the light emitting device so that the current is independent of the threshold voltage of the drive transistor, and is only associated with the fixed resistor, the voltage of the input data signal and the supply voltage. Thus, it is ensured that the current flowing through the light emitting device is stable and accurate, thereby making the light emitting device evenly emit light.

DETAILED DESCRIPTION

Figure 1:
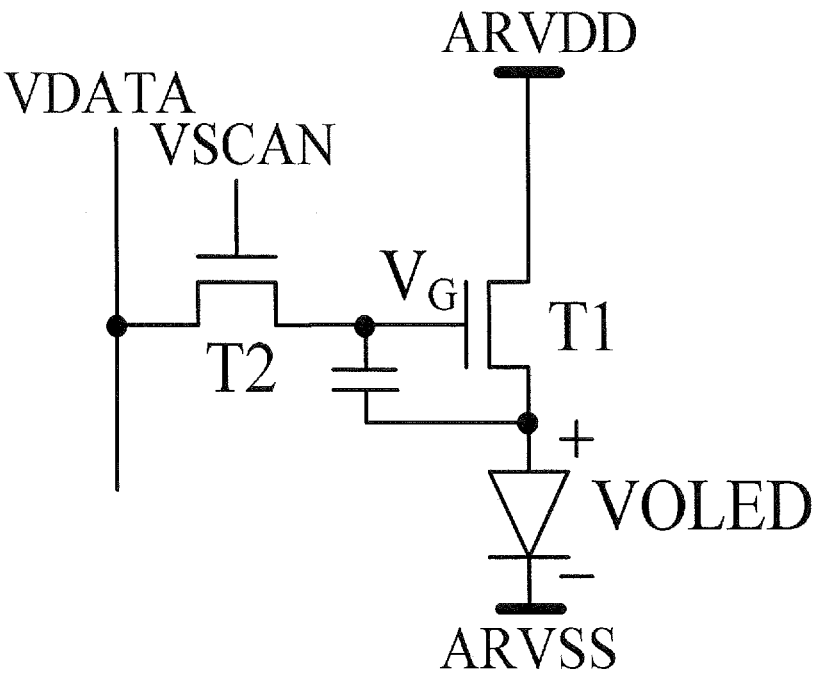
FIG. 1 shows a schematic structural diagram of a OLED drive circuit according to the prior art.

An embodiment of the present disclosure provides an actively driven organic light-emitting display apparatus to eliminate a defect in which the current flowing through the lighting device in the actively driven organic light-emitting display apparatus is affected by the instable current caused by an instable threshold voltage of the drive transistor, so that the current flowing through the lighting device is accurate and make the brightness of the whole actively driven organic light-emitting display apparatus be even.

The present disclosure utilizes a feedback loop to control the current of the light emitting device so that the current flowing through the light emitting device is accurate.

The actively driven organic light-emitting display apparatus according to the present disclosure comprises a plurality of pixels arranged in a matrix and a drive device for driving the plurality of pixels to display; the drive device comprises at least one drive circuit corresponding to one column of pixels, each of the pixels including a light emitting device, a light emitting device drive unit, a first switch unit and a second switch unit; each of the drive circuit including a current control unit, wherein for any pixel in any one column of pixels and its corresponding drive circuit, the light emitting device drive unit is configured to drive the light emitting device to emit light; the current control unit comprises a resistor and an operational amplifier, one terminal of the operational amplifier is coupled to data signal and the other terminal of the operation amplifier is couple to one terminal of the resistor; the light emitting device, the light emitting device drive unit, the first switch unit, the second switch unit, the current control unit and the resistor constitute a feedback loop so that a control signal provided from the current control unit based on the data signal and a signal provide by the feedback loop is determined by a resistance value of the resistor, the input data signal voltage and the supply voltage. The configuration and circuit of the apparatus provided by the present disclosure would be illustrated in conjunction with the accompany figures in the following.

The actively driven organic light-emitting display apparatus provide by the present invention comprises a plurality of pixels arranged in a matrix. The display apparatus further comprises a drive device for driving the plurality of pixels to display. The drive device comprises at least one drive circuit corresponding to one column of pixels, each of which includes a light emitting device, a light emitting device drive unit, a first switch unit and a second switch unit. Each of the drive circuits includes a resistor and a current control unit. Each of the drive circuits may comprise one or more resistors.

For any pixel in any one column of pixels and its corresponding drive circuit, the light emitting device drive unit is configured to drive the light emitting device to emit light; the current control unit comprises a resistor and an operational amplifier, one terminal of the operational amplifier is coupled to data signal and the other terminal of the operation amplifier is couple to one terminal of the resistor; the light emitting device, the light emitting device drive unit, the first switch unit, the second switch unit, the current control unit and the resistor constitute a feedback loop so that a control signal provided from the current control unit based on the data signal and a signal provide by the feedback loop is determined by a resistance value of the resistor, the input data signal voltage and the supply voltage.

In the embodiment of the present disclosure, the actively driven organic light-emitting display apparatus may be an active matrix organic light emitting display panel in which the drive device and the plurality of pixels are all provided on the display panel.

The display apparatus may also be an active matrix organic light emitting display device including a display panel and a circuit board, in which the plurality of pixels are provided on the display panel and the drive device is provided on the circuit board.

That is to say, the drive device may be an integrated drive IC, i.e. the current control unit and the resistor both are provided on the drive IC; or the drive device may comprise a drive chip IC, i.e. the current control unit is provided on the drive IC and the resistor is provided outside the drive IC. Furthermore, the whole drive device may be provided on the panel or some parts of the drive device is provided on the panel depending on an actual requirement.

Furthermore, for any pixel in any one column of pixels and its corresponding drive circuit, the light emitting device drive unit is configured to drive the light emitting device to emit light. One terminal of the first switch unit and the second switch unit is connected to an output terminal and a feedback terminal of the current control unit, respectively. The other terminals of the first switch unit and the second switch unit are connected to the light emitting device driving unit. The first switch unit controls connection or disconnection between the output terminal of the current control unit and the light emitting device drive unit by a voltage VSCAN of a row scan signal. The second switch unit controls connection or disconnection between the light emitting device drive unit and the feedback terminal of the current control unit and the connection or disconnection between the light emitting device drive unit and a ground node by inputting the row scan signal and an inversion signal of the row scan signal, respectively. In particular, the voltage VSCAN of the row scan signal is used to control a conduction between the light emitting device drive unit and the feedback terminal of the current control unit, and the voltage VSCANB of the inversion signal of the row scan signal is used to control a conduction between the light emitting device drive unit and the ground node. When the output terminal of the current control unit is connected to the light emitting device drive unit, the feedback terminal of the current control unit is also connected to the light emitting device drive unit and the light emitting device drive unit is disconnected from the ground node; and when the output terminal of the current control unit is disconnected from the light emitting device drive unit, the feedback terminal of the current control unit is also disconnected from the light emitting device drive unit and the light emitting device drive unit is connected to the ground node.

Figure 2:
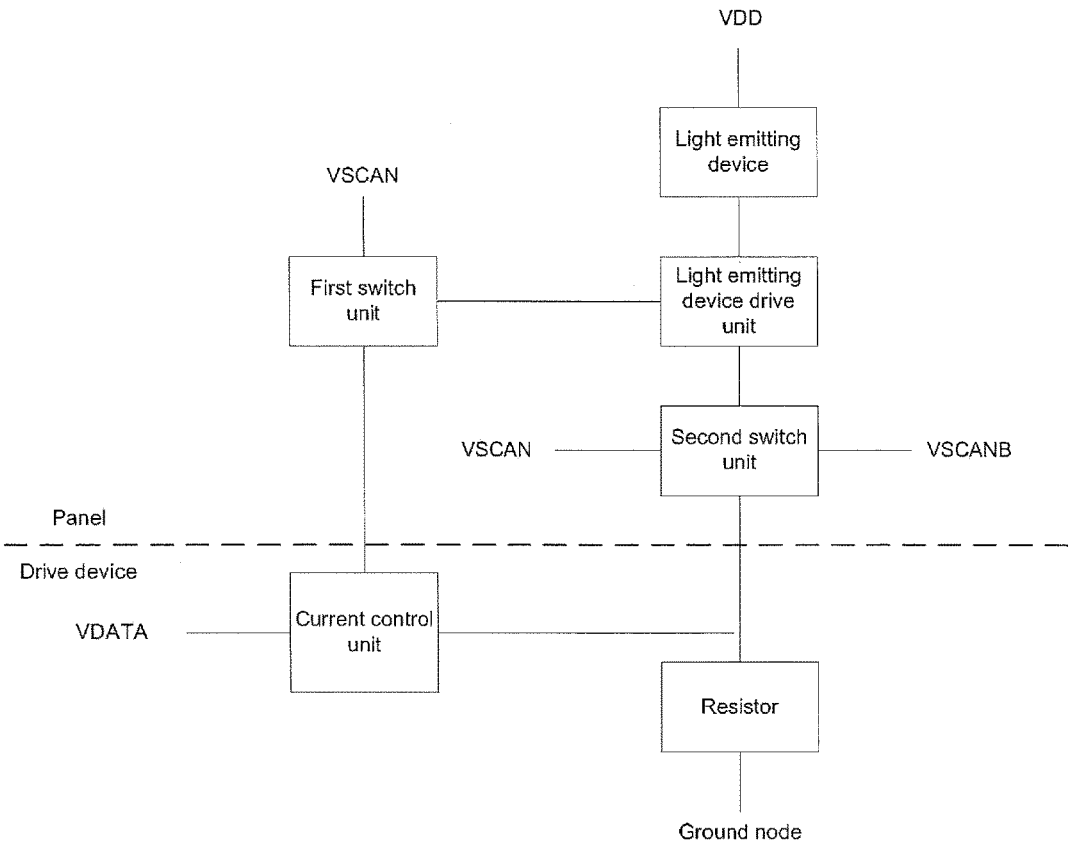
FIG. 2 shows schematic module configuration diagrams of one drive circuit in the driving device and one pixel in the panel within the actively driven organic light-emitting display apparatus according to an embodiment of the present disclosure, in which one terminal of the light emitting device is coupled to a high potential.
Figure 3:
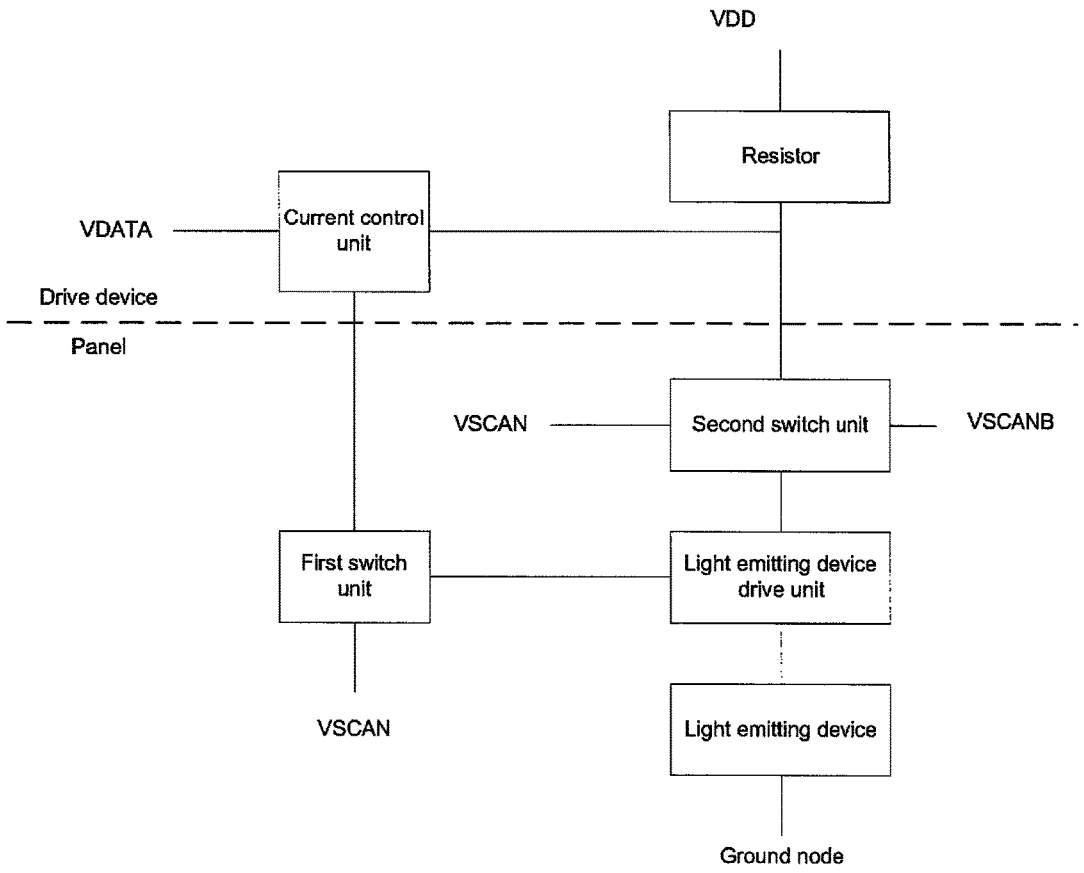
FIG. 3 shows schematic module configuration diagrams of one drive circuit in the driving device and one pixel the panel within the actively driven organic light-emitting display apparatus according to an embodiment of the present disclosure, in which one terminal of the light emitting device is coupled to a low potential.

By referring to FIG. 2, the light emitting device is connected between a power supply and the light emitting device drive unit, and the resistor is connected between the ground node and the feedback terminal of the current control unit; or by referring to FIG. 3, the light emitting device is connected between the ground node and the light emitting device drive unit, and the resistor is connected between the power supply and the feedback terminal of the current control unit.

In the embodiment of the present disclosure, when the light emitting device, the light emitting device drive unit, the first switch unit, the second switch unit, the current control unit and the resistor constitute a feedback loop, data signals are input to the input terminal of the current control unit to control the light emitting device by the voltage VDATA of the data signal, so that the current of the light emitting device so that the current is only associated with the resistor, the voltage VDATA of the input data signal and the supply voltage VDD. Thus, it is ensured that the current flowing through the light emitting device is accurate, which neither is affected by shift of the threshold voltage of the TFT, nor could be affected by variation of the operation voltage of the light emitting device.

Figure 4:
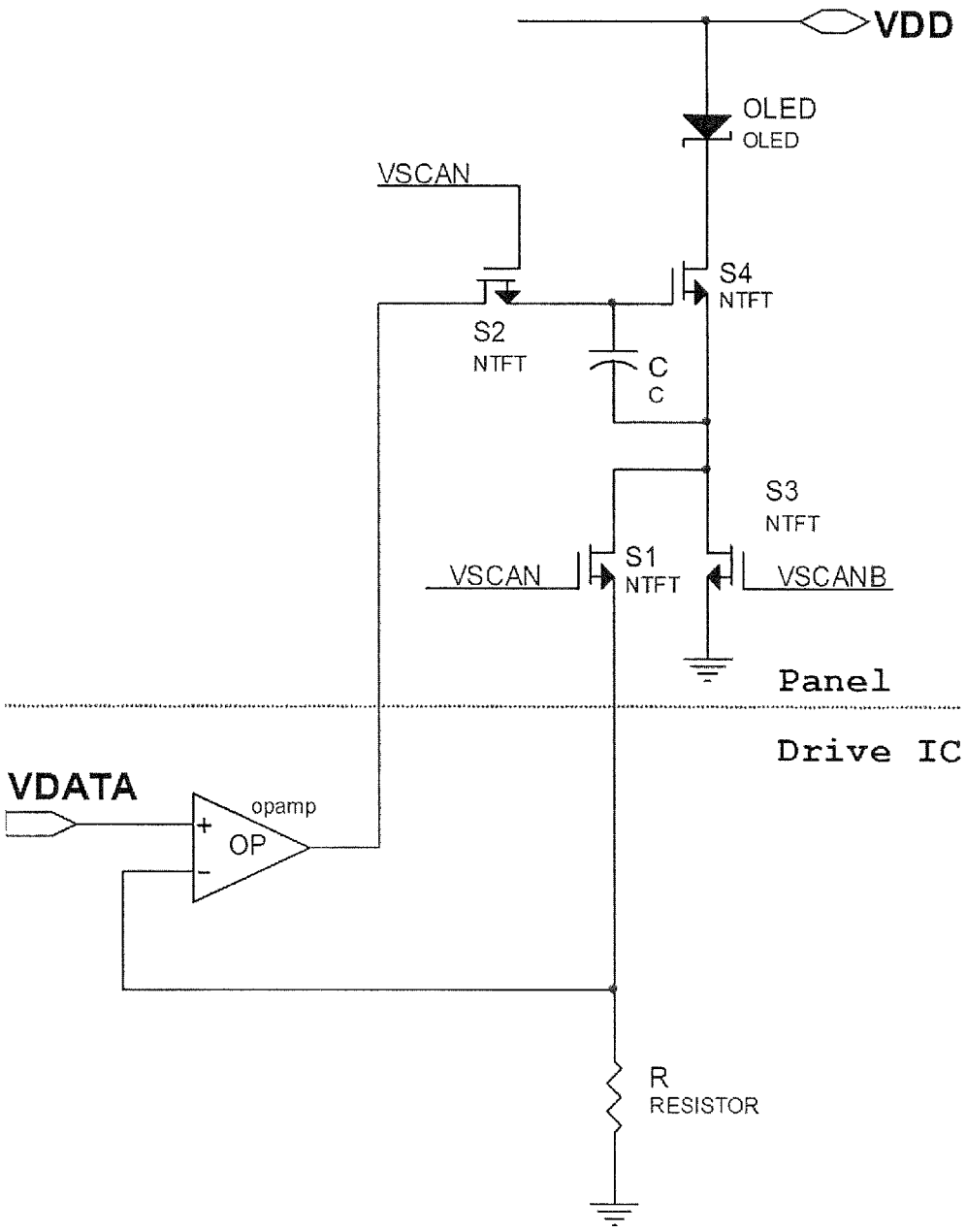
FIG. 4 shows schematic circuit configuration diagrams of one drive circuit in the driving device and one pixel the panel within the actively driven organic light-emitting display apparatus according to an embodiment of the present disclosure, in which all of the TFTs are N-type thin film transistor (NTFT), and one terminal of OLED is coupled to a high potential.
Figure 5:
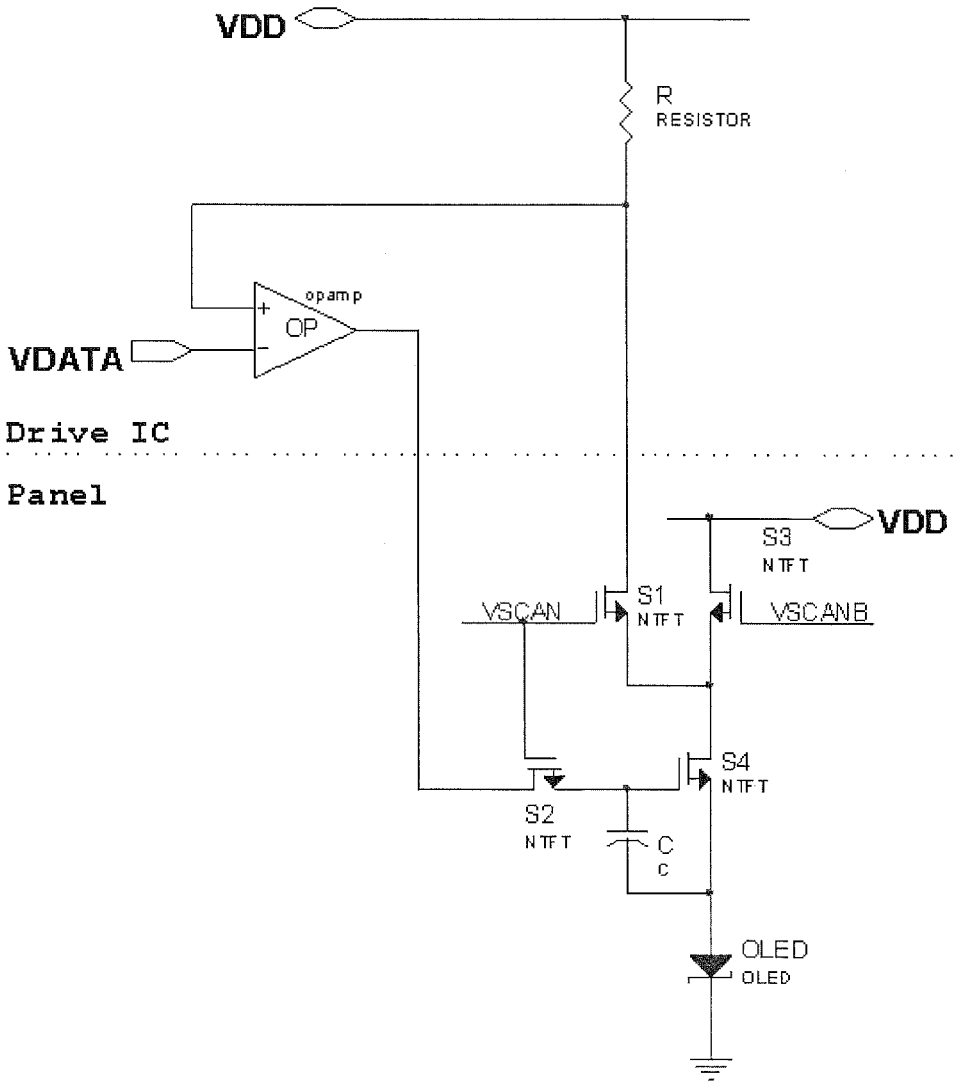
FIG. 5 shows schematic circuit configuration diagrams of one drive circuit in the driving device and one pixel the panel within the actively driven organic light-emitting display apparatus according to an embodiment of the present disclosure, in which all of the TFTs are N-type thin film transistor (NTFT), and one terminal of OLED is coupled to a low potential.
Figure 6:
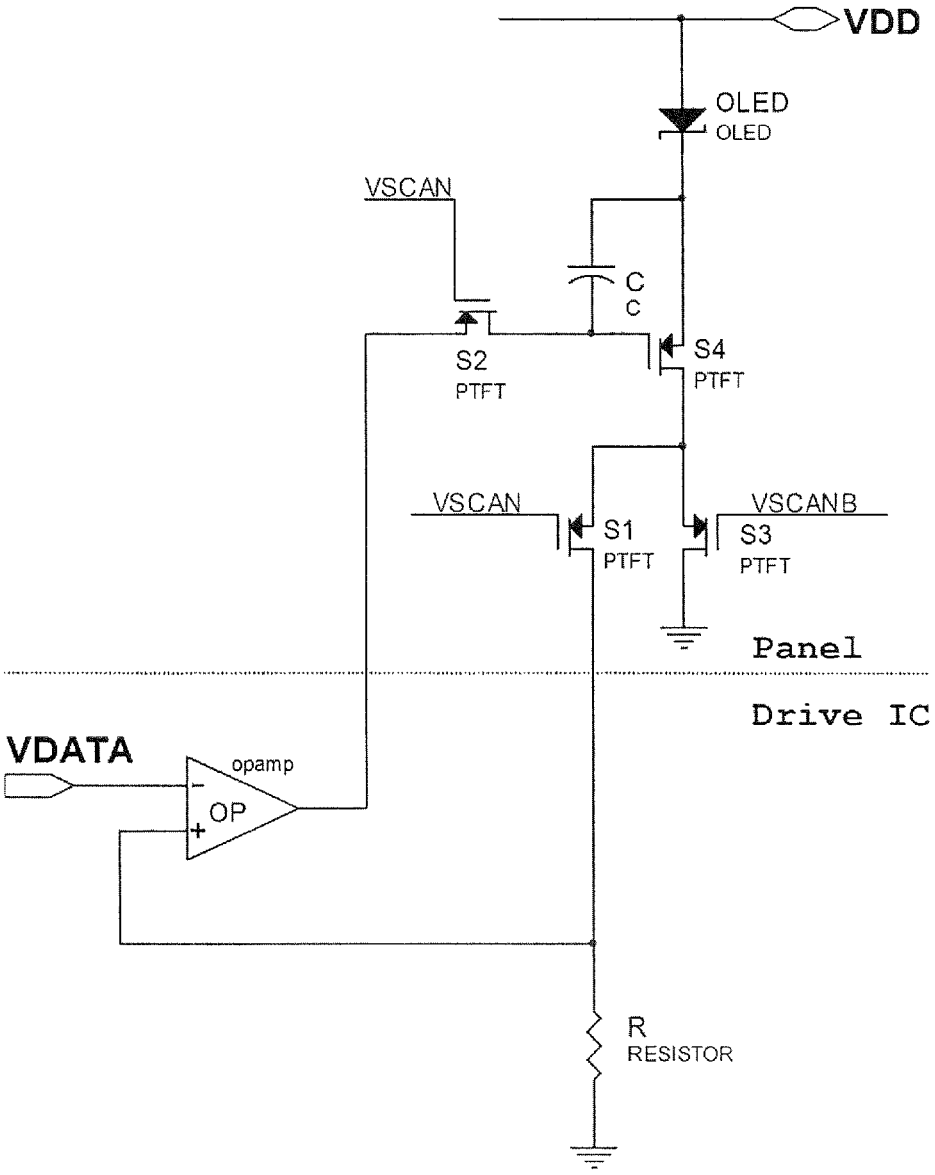
FIG. 6 shows schematic circuit configuration diagrams of one drive circuit in the driving device and one pixel the panel within the actively driven organic light-emitting display apparatus according to an embodiment of the present disclosure, in which all of the TFTs are P-type thin film transistor (PTFT), and one terminal of OLED is coupled to a high potential.
Figure 7:
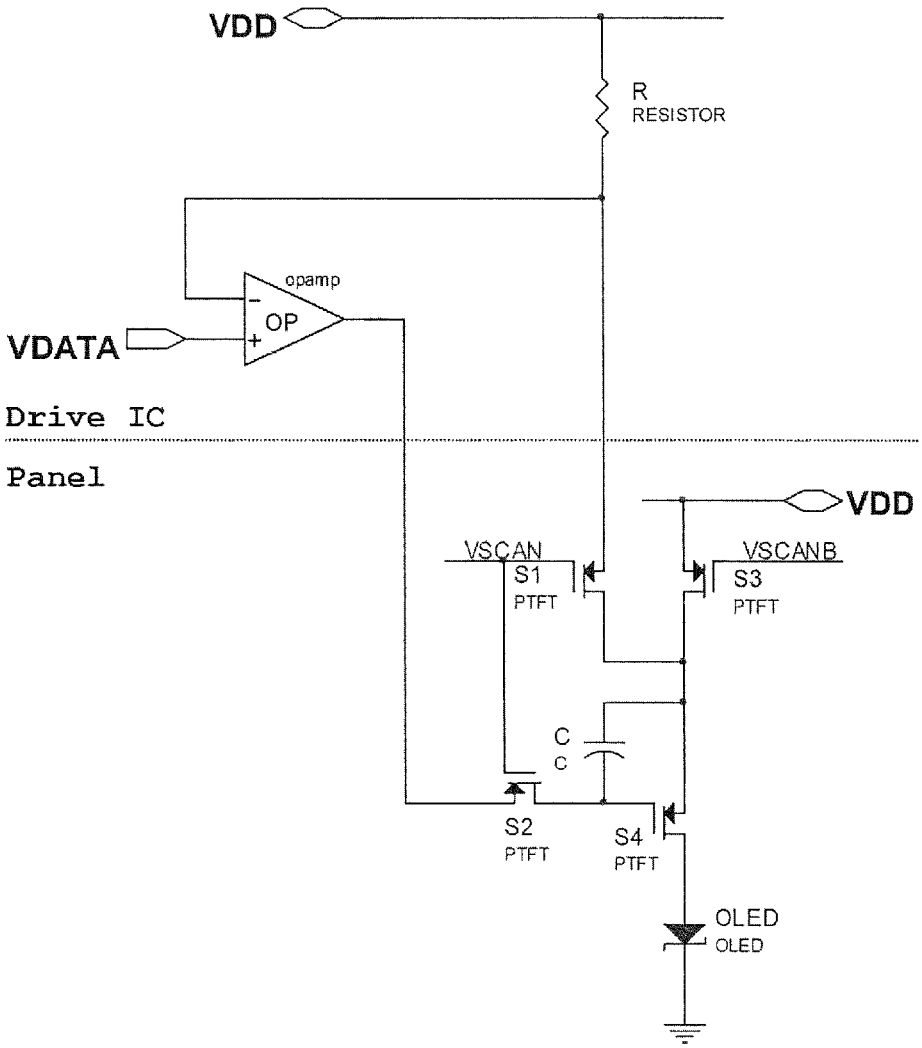
FIG. 7 shows schematic circuit configuration diagrams of one drive circuit in the driving device and one pixel the panel within the actively driven organic light-emitting display apparatus according to an embodiment of the present disclosure, in which all of the TFTs are P-type thin film transistor (PTFT), and one terminal of OLED is coupled to a low potential.

In the embodiment of the present invention, by referring to FIG. 4-7, the light emitting device is an OLED, the current control unit is an operational amplifier opamp, the resistor is R, the first switch unit is a first switch transistor S2, the second switch unit comprises a second switch transistor S1 and a third switch transistor D3, and the light emitting device drive unit is a drive transistor S4. The respective switch transistors and the drive transistor in FIG. 4 and FIG. 5 are all N-TFT, and the respective switch transistors and the drive transistor in FIG. 6 and FIG. 7 are all P-TFT.

In the embodiment of the present invention, one operational amplifier functioning as a buffer, the resistor R, and the respective TFT transistors and OLED within one pixel in the panel constitutes the feedback loop.

In particular, when the drive transistor S4 is an N-type thin film transistor, there is a following configuration.

By referring to FIG. 4, when the light emitting device OLED is connected between the power supply VDD and the drive transistor S4, and the resistor R is connected between the ground node and a feedback terminal of the current control unit (operational amplifier opamp), a capacitor C is connected between a gate of the drive transistor S4 and a source of the drive transistor S4, a drain of the drive transistor S4 is connected to the light emitting device OLED, and a source of the drive transistor S4 is connected to the second switch unit; a positive input terminal of the operational amplifier functions as an input terminal of the current control unit, and a negative input terminal of the operational amplifier functions as a feedback terminal of the current control unit.

By referring to FIG. 5, when the light emitting device OLED is connected between the ground node and the drive transistor S4, and the resistor R is connected between the power supply VDD and a feedback terminal of the current control unit (operational amplifier opamp), a capacitor C is connected between a gate of the drive transistor S4 and a source of the drive transistor S4, the source of the drive transistor S4 is connected to the light emitting device OLED, and the drain of the drive transistor S4 is connected to the second switch unit; the negative input terminal of the operational amplifier functions as an input terminal of the current control unit, and the positive input terminal of the operational amplifier functions as a feedback terminal of the current control unit.

In particular, when the drive transistor S4 is a P-type thin film transistor, there is a following configuration.

By referring to FIG. 6, when the light emitting device OLED is connected between the power supply VDD and the drive transistor S4, and the resistor R is connected between the ground node and a feedback terminal of the current control unit (operational amplifier opamp), a capacitor is connected between a gate of the drive transistor S4 and a source of the drive transistor S4, the source of the drive transistor S4 is connected to the light emitting device OLED, and a drain of the drive transistor S4 is connected to the second switch unit; a negative input terminal of the operational amplifier functions as an input terminal of the current control unit, and a positive input terminal of the operational amplifier functions as a feedback terminal of the current control unit.

By referring to FIG. 7, when the light emitting device OLED is connected between the ground node and the drive transistor S4, and the resistor R is connected between the power supply VDD and a feedback terminal of the current control unit (operational amplifier opamp), a capacitor is connected between a gate of the drive transistor S4 and the drain of the drive transistor S4, the drain of the drive transistor S4 is connected to the light emitting device OLED, and the source of the drive transistor S4 is connected to the second switch unit; the positive input terminal of the operational amplifier functions as an input terminal of the current control unit, and the negative input terminal of the operational amplifier functions as a feedback terminal of the current control unit.

In FIGS. 4 and 5, the first switch unit is a first switch transistor S2, and the first switch transistor S2 is an N-type thin film transistor. The gate of the first switch transistor S2 functions as an input terminal for the row scan signal and connected to a row scan signal line, the drain of the first switch transistor S2 is connected to the output terminal of the operational amplifier, and the source of the first switch transistor S2 is connected to the gate of the drive transistor.

In FIGS. 6 and 7, the first switch unit is the first switch transistor S2, and the first switch transistor S2 is a P-type thin film transistor. The gate of the first switch transistor S2 functions as the input terminal for the row scan signal and connected to the row scan signal line, the source of the first switch transistor S2 is connected to the output terminal of the operational amplifier, and the drain of the first switch transistor S2 is connected to the gate of the drive transistor.

By referring to FIGS. 4 and 6, when the light emitting device OLED is connected between the power supply VDD and the drive transistor S4, and the resistor R is connected between the ground node and the feedback terminal of the current control unit (operational amplifier opamp), one terminal of the second switch transistor S1 is connected to one terminal of the third switch transistor S3 and one terminal of the drive transistor S4. A gate of the second switch transistor S1 functions as an input terminal for the row scan signal and is connected to the row scan signal line. The other terminal of the second switch transistor S1 is connected to the feedback terminal of the current control unit. A gate of the third switch transistor S3 functions as an inversion signal input terminal for the row scan signal, and is connected to the inversion signal line for the row scan signal. The other terminal of the third switch transistor S3 is connected to the ground node.

By referring to FIGS. 5 and 7, when the light emitting device OLED is connected between the ground node and the drive transistor S4, and the resistor R is connected between the power supply VDD and the feedback terminal of the current control unit (operational amplifier opamp), one terminal of the second switch transistor S1 is connected to one terminal of the third switch transistor S3 and one terminal of the drive transistor S4. A gate of the second switch transistor S1 functions as an input terminal for the row scan signal and is connected to the row scan signal line. The other terminal of the second switch transistor S1 is connected to the feedback terminal of the current control unit. A gate of the third switch transistor S3 functions as an inversion signal input terminal for the row scan signal, and is connected to the inversion signal line for the row scan signal. The other terminal of the third switch transistor S3 is connected to the power supply.

To sum up, in the embodiment of the present invention, the circuit is mainly composed of an operational amplifier, a feedback resistor R, switch control transistors S1, S2, S3 and a drive transistor S4. The switch control transistors S1, S2 and S3 are controlled by voltages of the row selection signal (i.e. the voltage of the row scan signal VSCAN, in particular, S3 is controlled by the voltage VSCANB of the inversion signal of the row scan signal). The gate voltage of the drive transistor S4 is provided by the output voltage of the operational amplifier. The light emitting diode OLED is connected in series to the drive transistor S4, and a current flowing through the OLED is controlled by the drive transistor S4. In dependence on that one terminal of the OLED is connected to the ground or the high potential, the TFT transistors St S2, S3 and S4 may be NTFT or PTFT, and there are four possible configurations for the circuit which are shown in FIGS. 4, 5, 6 and 7, respectively.

In the embodiment of the present invention, the operational amplifier. The resistor, the TFT transistor in the panel and the light emitting device OLED constitute a feedback loop to control the current flowing through the OLED. The current flowing through the OLED is obtained by the operational amplifier driving the TFT transistor. The feedback configuration enables that the current flowing through the OLED is determined by VDATA (for the situation in which one terminal of the OLED is connected to the high potential) or (VDD−VDATA) (for the situation in which one terminal of the OLED is connected to the low potential).

That is, $I_{OLED}=V_{DATA}/R$ (for the situation in which one terminal of the OLED is connected to the high potential) or $I_{OLED}=(VDD-V_{DATA})/R$ (for the situation in which one terminal of the OLED is connected to the low potential).

As can be seen from it, the current of the OLED is not affected by the shift of the threshold voltage of the TFT and the variation of the voltage of the OLED.

In particular, for the configuration as shown in FIG. 4, at an initial state, VSCAN is at a low level, the transistors S1 and S2 are not turned on; the resistor R pulls down a level at the negative input terminal of the operational amplifier, and the output terminal of the operational amplifier is at a high level and is maintained at the high level. When VSCAN is at a high level, the transistors S1 and S2 are turned on to connect the operational amplifier and the transistor S4 to form a loop. The transistor S2 is turned on so that a gate voltage of the transistor S4 is equal to the output voltage of the operational amplifier, and a current is generated due to the turning on of the transistor S4 and a voltage is generated across the resistor R by the current flowing through the transistor S1. If the voltage across the resistor R is larger than the voltage VDATA, the output voltage of the operational amplifier becomes lower, so the current flowing through the transistor S4 is reduced and the voltage across the resistor R is correspondingly reduced and approaches to the voltage VDADA. In a stable state, the voltage across the resistor R is equal to the voltage VDATA. That is, the current flowing through the transistor S4 is determined by the voltage VDATA, so that the current of the OLED is accurate and may be defined.

For the configuration as shown in FIG. 5, at an initial state, VSCAN is at a low level, the transistors S1 and S2 are not turned on; the resistor R pulls down a level at the positive input terminal of the operational amplifier, and the output terminal of the operational amplifier is at a high level and is maintained at the high level. When VSCAN is at a high level, the transistors S1 and S2 are turned on to connect the operational amplifier and the transistor S4 to form a loop. The transistor S2 is turned on so that a gate voltage of the transistor S4 is equal to the output voltage of the operational amplifier, and a current is generated due to the turning on of the transistor S4 and a voltage is generated across the resistor R by the current flowing through the transistor S1. If the voltage across the resistor R is larger than the voltage (VDD−VDATA), the output voltage of the operational amplifier becomes lower, so the current flowing through the transistor S4 is reduced and the voltage across the resistor R is correspondingly reduced and approaches to the voltage (VDD−VDADA). In a stable state, the voltage across the resistor R is equal to the voltage (VDD−VDATA). That is, the current flowing through the transistor S4 is determined by the voltage (VDD−VDATA), so that the current of the OLED is accurate and may be defined.

The signal VSCAN is a row selection signal for the panel and is valid at a high level for the NTFT transistor; and the signal VSCANB is an inversion signal of VSCAN. If the current row is not selected, the signal VSCANB is at a high level, i.e. the transistor S3 is turned on to pull down the source of the drive transistor S4 to the ground potential; and if the signal VSCAN is at a low level the transistors S1 and S2 are turned off. The capacitor C is used to maintain a gate-source voltage of the transistor S4 not to abruptly change.

Due to the symmetry of the P-type and N-type transistors, the circuit as mentioned above may also be implemented by the P-type TFT, the configurations of which are shown in FIG. 6 and FIG. 7, respectively, and the principles of which are similar and will not be illustrated again.

Figure 8:
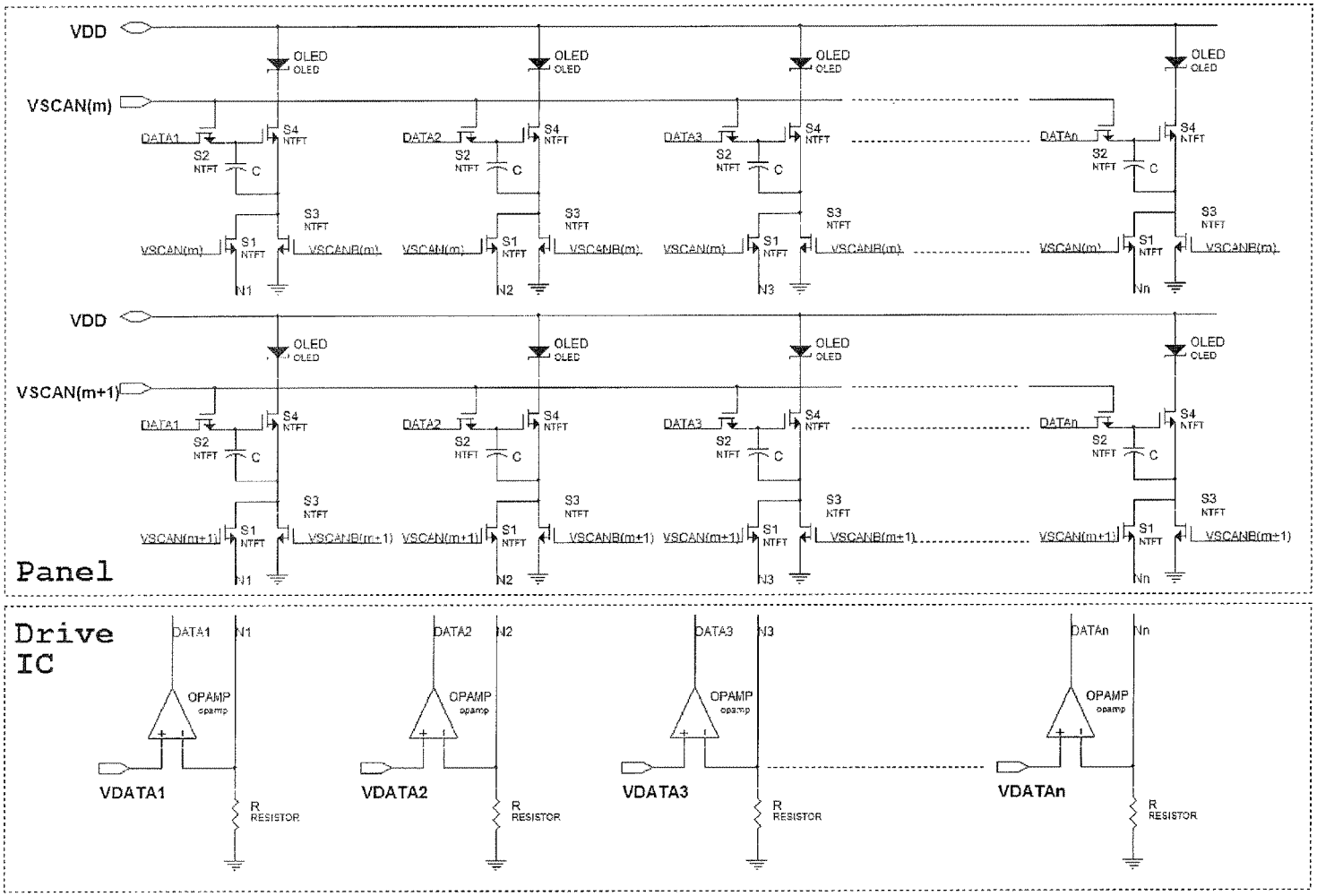
FIG. 8 shows a whole circuit configuration diagrams of the driving device and the panel within the actively driven organic light-emitting display apparatus according to an embodiment of the present disclosure, in which all of the TFTs are N-type thin film transistor (PTFT), and one terminal of OLED is coupled to a high potential.
Figure 9:
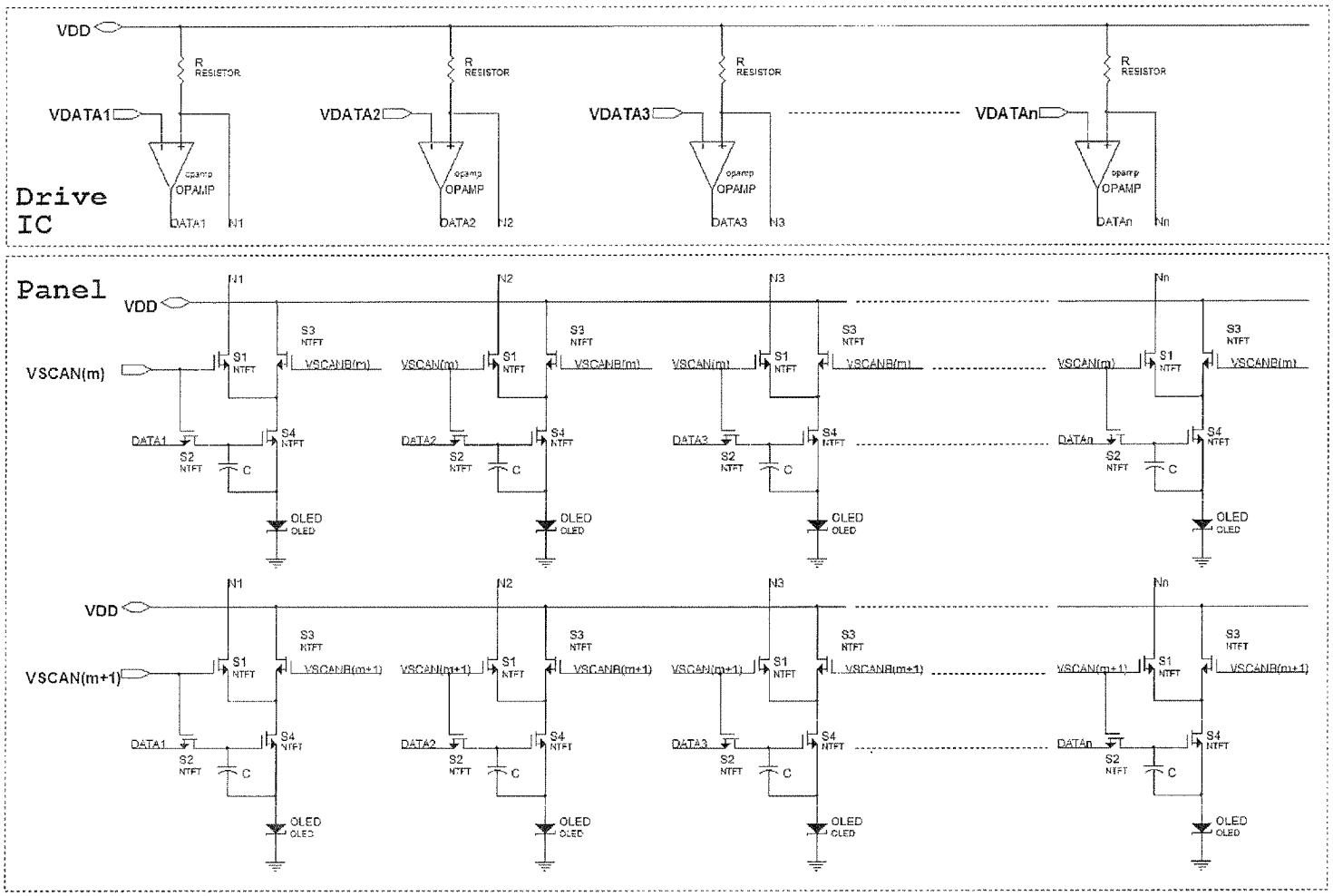
FIG. 9 shows a whole circuit configuration diagrams of the driving device and the panel within the actively driven organic light-emitting display apparatus according to an embodiment of the present disclosure, in which all of the TFTs are N-type thin film transistor (PTFT), and one terminal of OLED is coupled to a low potential.

As shown in FIG. 8 and FIG. 9 (by taking the NTFT as an example), for the whole panel, each column of pixels correspond to one drive circuit in common, and n columns of pixels correspond to n operational amplifier and n resistors (of course, there may be X resistors, in which X is larger than n, e.g. X=2n; that is to say, one drive circuit comprises two resistors connected in series and one operational amplifier). The voltage at the input terminal of each of the operational amplifiers is a grayscale voltage required by the current turned on pixel. For the panel having M rows×n columns of pixels, there need n drive circuits.

That is to say, the respective points N1 in the first column of pixels are connected to the points N1 of the drive circuit corresponding to the first column of pixels, and the respective points DATA1 in the first column of pixels are connected to the points DATA1 of the drive circuit corresponding to the first column of pixels; the respective points N2 in the second column of pixels are connected to the points N2 of the drive circuit corresponding to the second column of pixels, and the respective points DATA2 in the second column of pixels are connected to the points DATA2 of the drive circuit corresponding to the second column of pixels; by analogy, the respective points Nn in the $n^{th}$ column of pixels are connected to the points Nn of the drive circuit corresponding to the $n^{th}$ column of pixels, and the respective points DATAn in the $n^{th}$ column of pixels are connected to the points DATAn of the drive circuit corresponding to the $n^{th}$ column of pixels. The resistors R in different drive circuits may be different and the particular values for the resistor may be set based on actual requirements.

The drive circuit corresponding to the same column of pixels comprises one operational amplifier and one resistor, and the switch transistors S1, S2 and S3 connected via the gate and source of the transistor S4 for the corresponding pixel in the panel are controlled by the row scan signal and the inversion signal of the row scan signal so as to select which row of the pixel in the column of pixels to be connected to the drive circuit.

As shown in FIG. 8 and FIG. 9, when the respective pixels in the $m^{th}$ row are selected to be connected to the corresponding drive circuit, the corresponding grayscale voltages VDATA1, VDATA2, VDATA3, . . . VDATAn are assigned to input terminals of n operational amplifiers to drive all of the columns of pixels in the $m^{th}$ row are lighten. When the respective pixels in the $(m+1)^{th}$ row are selected to be conducted to the corresponding drive circuit, the operational amplifier switches off the connection with the respective pixels in the $m^{th}$ row by the switch transistors for the respective pixels in the $m^{th}$ row, and switches on the respective pixels in the $(m+1)^{th}$ row by the switch transistors for the respective pixels in the $(m+1)^{th}$ row so as to utilize updated grayscale voltages VDATA1, VDATA2, VDATA3, . . . VDATAn to drive the respective pixels in the $(m+1)^{th}$ row to be lighten.

It is obvious for those skilled in the art to make any changes and modifications to the present invention within the scope and spirit of the present invention. Thus, if these changes and modifications to the present invention fall in the scope of claims of the present invention and its equivalence, the present invention intends to encompass all of these changes and modifications.

We claim:

1. An actively driven organic light-emitting display apparatus, comprising a plurality of pixels arranged in a matrix and a drive device for driving the plurality of pixels to display; the drive device comprises at least one drive circuit corresponding to one column of pixels, each of the pixels including a light emitting device, a light emitting device drive unit, a first switch unit and a second switch unit; each of the drive circuit including a current control unit, wherein for any pixel in any one column of pixels and its corresponding drive circuit, the light emitting device drive unit is configured to drive the light emitting device to emit light;

the current control unit comprises a resistor and an operational amplifier, one terminal of the operational amplifier is coupled to data signal and the other terminal of the operation amplifier is coupled to one terminal of the resistor; the light emitting device, the light emitting device drive unit, the first switch unit, the second switch unit, the current control unit and the resistor constitute a feedback loop so that a control signal provided from the current control unit based on the data signal and a signal provide by the feedback loop is automatically determined by a resistance value of the resistor, an input data signal voltage and a supply voltage, wherein the light emitting device drive unit comprise a drive transistor and a capacitor, and the drive transistor is an N-type thin film transistor;

when the light emitting device is connected between the power supply and the light emitting device unit, and the resistor is connected between the ground node and the feedback terminal of the current control unit, the capacitor is connected between a gate and a source of the drive transistor, a drain of the drive transistor is connected to the light emitting device, and the source of the drive transistor is connected to the second switch unit;

when the light emitting device is connected between the ground node and the light emitting device drive unit, and the resistor is connected between the power supply and the feedback terminal of the current control unit, the capacitor is connected between the gate and the source of the drive transistor, the source of the drive transistor is connected to the light emitting device, and the drain of the drive transistor is connected to the second switch unit.

2. The actively driven organic light-emitting display apparatus according to claim 1, wherein one terminal of the first switch unit and the second switch unit is connected to an output terminal and a feedback terminal of the current control unit, the other terminal of the first switch unit and the second switch unit is connected to the light emitting device driving unit; the first switch unit controls connection or disconnection between the output terminal of the current control unit and the light emitting device drive unit by inputting a row scan signal, the second switch unit controls connection or disconnection between the light emitting device drive unit and the feedback terminal of the current control unit and the connection or disconnection between the light emitting device drive unit and a ground node by inputting the row scan signal and an inversion signal of the row scan signal, respectively; when the output terminal of the current control unit is connected to the light emitting device drive unit, the feedback terminal of the current control unit is also connected to the light emitting device drive unit and the light emitting device drive unit is disconnected from the ground node; and when the output terminal of the current control unit is disconnected from the light emitting device drive unit, the feedback terminal of the current control unit is also disconnected from the light emitting device drive unit and the light emitting device drive unit is connected to the ground node;

the light emitting device is connected between a power supply and the light emitting device drive unit, and the resistor is connected between the ground node and the feedback terminal of the current control unit; or the light emitting device is connected between the ground node and the light emitting device drive unit, and the resistor is connected between the power supply and the feedback terminal of the current control unit.

3. The actively driven organic light-emitting display apparatus according to claim 1, wherein the light emitting device is an OLED.

4. An actively driven organic light-emitting display apparatus, comprising a plurality of pixels arranged in a matrix and a drive device for driving the plurality of pixels to display; the drive device comprises at least one drive circuit corresponding to one column of pixels, each of the pixels including a light emitting device, a light emitting device drive unit, a first switch unit and a second switch unit; each of the drive circuit including a current control unit, wherein for any pixel in any one column of pixels and its corresponding drive circuit, the light emitting device drive unit is configured to drive the light emitting device to emit light;

the current control unit comprises a resistor and an operational amplifier, one terminal of the operational amplifier is coupled to data signal and the other terminal of the operation amplifier is coupled to one terminal of the resistor; the light emitting device, the light emitting device drive unit, the first switch unit, the second switch unit, the current control unit and the resistor constitute a feedback loop so that a control signal provided from the current control unit based on the data signal and a signal provide by the feedback loop is automatically determined by a resistance value of the resistor, an input data signal voltage and a supply voltage, wherein the light emitting device drive unit comprise a drive transistor and a capacitor, and the drive transistor is a P-type thin film transistor;

when the light emitting device is connected between the power supply and the light emitting device drive unit, and the resistor is connected between the ground node and the feedback terminal of the current control unit, the capacitor is connected between a gate and a source of the drive transistor, a source of the drive transistor is connected to the light emitting device, and a drain of the drive transistor is connected to the second switch unit;

when the light emitting device is connected between the ground node and the light emitting device drive unit, and the resistor is connected between the power supply and the feedback terminal of the current control unit, the capacitor is connected between the gate and the source of the drive transistor, a drain of the drive transistor is connected to the light emitting device, and the source of the drive transistor is connected to the second switch unit.

5. The actively driven organic light-emitting display apparatus according to claim 1, wherein the first switch unit comprise a first switch transistor;

when the first switch transistor is an N-type thin film transistor, a gate of the first switch transistor functions as an input terminal for the row scan signal and connected to the row scan signal line, a drain of the first switch transistor is connected to an output terminal of the operational amplifier, and a source of the first switch transistor is connected to a gate of the drive transistor;

when the first switch transistor is a P-type thin film transistor, the gate of the first switch transistor functions as the input terminal for the row scan signal and is connected, to the row scan signal line, the source of the first switch transistor is connected to the output terminal of the operational amplifier, and the drain of the first switch transistor is connected to the gate of the drive transistor.

6. The actively driven organic light-emitting display apparatus according to claim 5, wherein the second switch unit comprise a second switch transistor and a third switch transistor, and the second switch transistor and the third switch transistor both are N-type thin film transistors;

when the light emitting device is connected between the power supply and the light emitting device drive unit, and the resistor is connected between the ground node and the feedback terminal of the current control unit, a drain of the second switch transistor is connected to a drain of the third switch transistor and the source of the drive transistor, a gate of the second switch transistor functions as an input terminal for the row scan signal and is connected to the row scan signal line, a source of the second switch transistor is connected to the feedback terminal of the current control unit, a gate of the third switch transistor functions as an inversion signal input terminal for the row scan signal and is connected to an inversion signal line for the row scan signal, and a source of the third switch transistor is connected to the ground node;

when the light emitting device is connected between the ground node and the light emitting device drive unit, and the resistor is connected between the power supply and the feedback terminal of the current control unit, the source of the second switch transistor is connected to the source of the third switch transistor and the drain of the drive transistor, the gate of the second switch transistor functions as the input terminal for the row scan signal and is connected to the row scan signal line, the drain of the second switch transistor is connected to the feedback terminal of the current control unit, the gate of the third switch transistor functions as the inversion signal input terminal for the row scan signal and is connected to the inversion signal line for the row scan signal, and the drain of the third switch transistor is connected to the power supply.

7. The actively driven organic light-emitting display apparatus according to claim 6, wherein the second switch unit comprise a second switch transistor and a third switch transistor, and the second switch transistor and the third switch transistor both are P-type thin film transistors;

when the light emitting device is connected between the power supply and the light emitting device drive unit, and the resistor is connected between the ground node and the feedback terminal of the current control unit, a source of the second switch transistor is connected to a source of the third switch transistor and the drain of the drive transistor, a gate of the second switch transistor functions as an input terminal for the row scan signal and is connected to the row scan signal line, a drain of the second switch transistor is connected to the feedback terminal of the current control unit, a gate of the third switch transistor functions as an inversion signal input terminal for the row scan signal and is connected to an inversion signal line for the row scan signal, and a drain of the third switch transistor is connected to the ground node;

when the light emitting device is connected between the ground node and the light emitting device drive unit, and the resistor is connected between the power supply and the feedback terminal of the current control unit, the drain of the second switch transistor is connected to the drain of the third switch transistor and the source of the drive transistor, the gate of the second switch transistor functions as the input terminal for the row scan signal and is connected to the row scan signal line, the source of the second switch transistor is connected to the feedback terminal of the current control unit, the gate of the third switch transistor functions as the inversion signal input terminal for the row scan signal and is connected to the inversion signal line for the row scan signal, and the source of the third switch transistor is connected to the power supply.

8. The actively driven organic light-emitting display apparatus according to claim 6, wherein the current control unit is an operational amplifier;

if the first switch transistor, the second switch transistor and the third switch transistor are all N-type thin film transistors:

when the light emitting device is connected between the power supply and the light emitting device drive unit, and the resistor is connected between the ground node and the feedback terminal of the current control unit, a positive input terminal of the operational amplifier functions as the input terminal of the current control unit and a negative input terminal of the operational amplifier functions as the feedback terminal of the current control unit; and when the light emitting device is connected between the ground node and the light emitting device drive unit, and the resistor is connected between the power supply and the feedback terminal of the current control unit, a negative input terminal of the operational amplifier functions as the input terminal of the current control unit and a positive input terminal of the operational amplifier functions as the feedback terminal of the current control unit;

if the first switch transistor, the second switch transistor and the third switch transistor are all P-type thin film transistors:

when the light emitting device is connected between the power supply and the light emitting device drive unit, and the resistor is connected between the ground node and the feedback terminal of the current control unit, the negative input terminal of the operational amplifier functions as the input terminal of the current control unit and the positive input terminal of the operational amplifier functions as the feedback terminal of the current control unit; and when the light emitting device is connected between the ground node and the light emitting device drive unit, and the resistor is connected between the power supply and the feedback terminal of the current control unit, the positive input terminal of the operational amplifier functions as the input terminal of the current control unit and the negative input terminal of the operational amplifier functions as the feedback terminal of the current control unit.

9. The actively driven organic light-emitting display apparatus according to claim 7, wherein the current control unit is an operational amplifier;

if the first switch transistor, the second switch transistor and the third switch transistor are all N-type thin film transistors:

when the light emitting device is connected between the power supply and the light emitting device drive unit, and the resistor is connected between the ground node and the feedback terminal of the current control unit, a positive input terminal of the operational amplifier functions as the input terminal of the current control unit and a negative input terminal of the operational amplifier functions as the feedback terminal of the current control unit; and when the light emitting device is connected between the ground node and the light emitting device drive unit, and the resistor is connected between the power supply and the feedback terminal of the current control unit, a negative input terminal of the operational amplifier functions as the input terminal of the current control unit and a positive input terminal of the operational amplifier functions as the feedback terminal of the current control unit;

if the first switch transistor, the second switch transistor and the third switch transistor are all P-type thin film transistors:

when the light emitting device is connected between the power supply and the light emitting device drive unit, and the resistor is connected between the ground node and the feedback terminal of the current control unit, the negative input terminal of the operational amplifier functions as the input terminal of the current control unit and the positive input terminal of the operational amplifier functions as the feedback terminal of the current control unit; and when the light emitting device is connected between the ground node and the light emitting device drive unit, and the resistor is connected between the power supply and the feedback terminal of the current control unit, the positive input terminal of the operational amplifier functions as the input terminal of the current control unit and the negative input terminal of the operational amplifier functions as the feedback terminal of the current control unit.

10. The actively driven organic light-emitting display apparatus according to claim 2, wherein the first switch unit comprise a first switch transistor;

when the first switch transistor is an N-type thin film transistor, a gate of the first switch transistor functions as an input terminal for the row scan signal and connected to the row scan signal line, a drain of the first switch transistor is connected to an output terminal of the operational amplifier, and a source of the first switch transistor is connected to a gate of the drive transistor;

when the first switch transistor is a P-type thin film transistor, the gate of the first switch transistor functions as the input terminal for the row scan signal and is connected, to the row scan signal line, the source of the first switch transistor is connected to the output terminal of the operational amplifier, and the drain of the first switch transistor is connected to the gate of the drive transistor.

11. The actively driven organic light-emitting display apparatus according to claim 10, wherein the second switch unit comprise a second switch transistor and a third switch transistor, and the second switch transistor and the third switch transistor both are N-type thin film transistors;

when the light emitting device is connected between the power supply and the light emitting device drive unit, and the resistor is connected between the ground node and the feedback terminal of the current control unit, a drain of the second switch transistor is connected to a drain of the third switch transistor and the source of the drive transistor, a gate of the second switch transistor functions as an input terminal for the row scan signal and is connected to the row scan signal line, a source of the second switch transistor is connected to the feedback terminal of the current control unit, a gate of the third switch transistor functions as an inversion signal input terminal for the row scan signal and is connected to an inversion signal line for the row scan signal, and a source of the third switch transistor is connected to the ground node;

when the light emitting device is connected between the ground node and the light emitting device drive unit, and the resistor is connected between the power supply and the feedback terminal of the current control unit, the source of the second switch transistor is connected to the source of the third switch transistor and the drain of the drive transistor, the gate of the second switch transistor functions as the input terminal for the row scan signal and is connected to the row scan signal line, the drain of the second switch transistor is connected to the feedback terminal of the current control unit, the gate of the third switch transistor functions as the inversion signal input terminal for the row scan signal and is connected to the inversion signal line for the row scan signal, and the drain of the third switch transistor is connected to the power supply.

12. The actively driven organic light-emitting display apparatus according to claim 10, wherein the second switch unit comprise a second switch transistor and a third switch transistor, and the second switch transistor and the third switch transistor both are P-type thin film transistors;

when the light emitting device is connected between the power supply and the light emitting device drive unit, and the resistor is connected between the ground node and the feedback terminal of the current control unit, a source of the second switch transistor is connected to a source of the third switch transistor and the drain of the drive transistor, a gate of the second switch transistor functions as an input terminal for the row scan signal and is connected to the row scan signal line, a drain of the second switch transistor is connected to the feedback terminal of the current control unit, a gate of the third switch transistor functions as an inversion signal input terminal for the row scan signal and is connected to an inversion signal line for the row scan signal, and a drain of the third switch transistor is connected to the ground node;

when the light emitting device is connected between the ground node and the light emitting device drive unit, and the resistor is connected between the power supply and the feedback terminal of the current control unit, the drain of the second switch transistor is connected to the drain of the third switch transistor and the source of the drive transistor, the gate of the second switch transistor functions as the input terminal for the row scan signal and is connected to the row scan signal line, the source of the second switch transistor is connected to the feedback terminal of the current control unit, the gate of the third switch transistor functions as the inversion signal input terminal for the row scan signal and is connected to the inversion signal line for the row scan signal, and the source of the third switch transistor is connected to the power supply.

13. The actively driven organic light-emitting display apparatus according to claim 11, wherein the current control unit is an operational amplifier;

if the first switch transistor, the second switch transistor and the third switch transistor are all N-type thin film transistors:

when the light emitting device is connected between the power supply and the light emitting device drive unit, and the resistor is connected between the ground node and the feedback terminal of the current control unit, a positive input terminal of the operational amplifier functions as the input terminal of the current control unit and a negative input terminal of the operational amplifier functions as the feedback terminal of the current control unit; and when the light emitting device is connected between the ground node and the light emitting device drive unit, and the resistor is connected between the power supply and the feedback terminal of the current control unit, a negative input terminal of the operational amplifier functions as the input terminal of the current control unit and a positive input terminal of the operational amplifier functions as the feedback terminal of the current control unit;

if the first switch transistor, the second switch transistor and the third switch transistor are all P-type thin film transistors:

when the light emitting device is connected between the power supply and the light emitting device drive unit, and the resistor is connected between the ground node and the feedback terminal of the current control unit, the negative input terminal of the operational amplifier functions as the input terminal of the current control unit and the positive input terminal of the operational amplifier functions as the feedback terminal of the current control unit; and when the light emitting device is connected between the ground node and the light emitting device drive unit, and the resistor is connected between the power supply and the feedback terminal of the current control unit, the positive input terminal of the operational amplifier functions as the input terminal of the current control unit and the negative input terminal of the operational amplifier functions as the feedback terminal of the current control unit.

14. The actively driven organic light-emitting display apparatus according to claim 12, wherein the current control unit is an operational amplifier;

if the first switch transistor, the second switch transistor and the third switch transistor are all N-type thin film transistors:

when the light emitting device is connected between the power supply and the light emitting device drive unit, and the resistor is connected between the ground node and the feedback terminal of the current control unit, a positive input terminal of the operational amplifier functions as the input terminal of the current control unit and a negative input terminal of the operational amplifier functions as the feedback terminal of the current control unit; and when the light emitting device is connected between the ground node and the light emitting device drive unit, and the resistor is connected between the power supply and the feedback terminal of the current control unit, a negative input terminal of the operational amplifier functions as the input terminal of the current control unit and a positive input terminal of the operational amplifier functions as the feedback terminal of the current control unit;

if the first switch transistor, the second switch transistor and the third switch transistor are all P-type thin film transistors:

when the light emitting device is connected between the power supply and the light emitting device drive unit, and the resistor is connected between the ground node and the feedback terminal of the current control unit, the negative input terminal of the operational amplifier functions as the input terminal of the current control unit and the positive input terminal of the operational amplifier functions as the feedback terminal of the current control unit; and when the light emitting device is connected between the ground node and the light emitting device drive unit, and the resistor is connected between the power supply and the feedback terminal of the current control unit, the positive input terminal of the operational amplifier functions as the input terminal of the current control unit and the negative input terminal of the operational amplifier functions as the feedback terminal of the current control unit.

15. The actively driven organic light-emitting display apparatus according to claim 1, wherein the display apparatus is an active matrix organic light emitting display panel in which the drive device and the plurality of pixels are all provided on the display panel; or the display apparatus is an active matrix organic light emitting display device including a display panel and a circuit board, in which the plurality of pixels are provided on the display panel and the drive device is provided on the circuit board.

* * * * *